United States Patent [19]

Barroyer et al.

[11] Patent Number: 4,676,303

[45] Date of Patent: Jun. 30, 1987

[54] HEAT EXCHANGER HAVING REMOVABLE EXCHANGE SURFACES

[75] Inventors: Paul Barroyer, Villeneuve d'Ascq; Bernard Foucher, Chereng-Gruson; Claude Ladent, Linselles; Jean P. Wicke, Mons, all of France

[73] Assignee: Etablissements Neu, Lille, France

[21] Appl. No.: 867,670

[22] Filed: May 28, 1986

[30] Foreign Application Priority Data

May 30, 1985 [FR] France ..... 85 08153

[51] Int. Cl.[4] ..... F28F 7/00

[52] U.S. Cl. ..... 165/78; 165/82

[58] Field of Search ..... 165/78, 81, 82

[56] References Cited

U.S. PATENT DOCUMENTS

| | | | |
|---|---|---|---|
| 1,991,897 | 2/1935 | Higgins | 165/78 X |
| 2,038,002 | 4/1936 | Ris | 165/78 X |
| 3,447,598 | 6/1969 | Kaess, Jr. | 165/78 X |
| 4,234,039 | 11/1980 | Almen | 165/78 X |

*Primary Examiner*—Albert W. Davis, Jr.
*Assistant Examiner*—Richard R. Cole
*Attorney, Agent, or Firm*—Beveridge, DeGrandi and Weilacher

[57] ABSTRACT

Heat exchanger comprising a casing and tubular or plate-type exchange surfaces mounted inside the casing. The exchange surfaces (15) are joined together in the form of at least one module (14) comprising two end plates (16, 17) between which the exchange surfaces (15) are disposed, said plates (16, 17) being mounted slidingly after the style of drawers in rails (8, 9) of the casing (1). Application: particularly in low-temperature recuperative heat exchangers.

5 Claims, 1 Drawing Figure

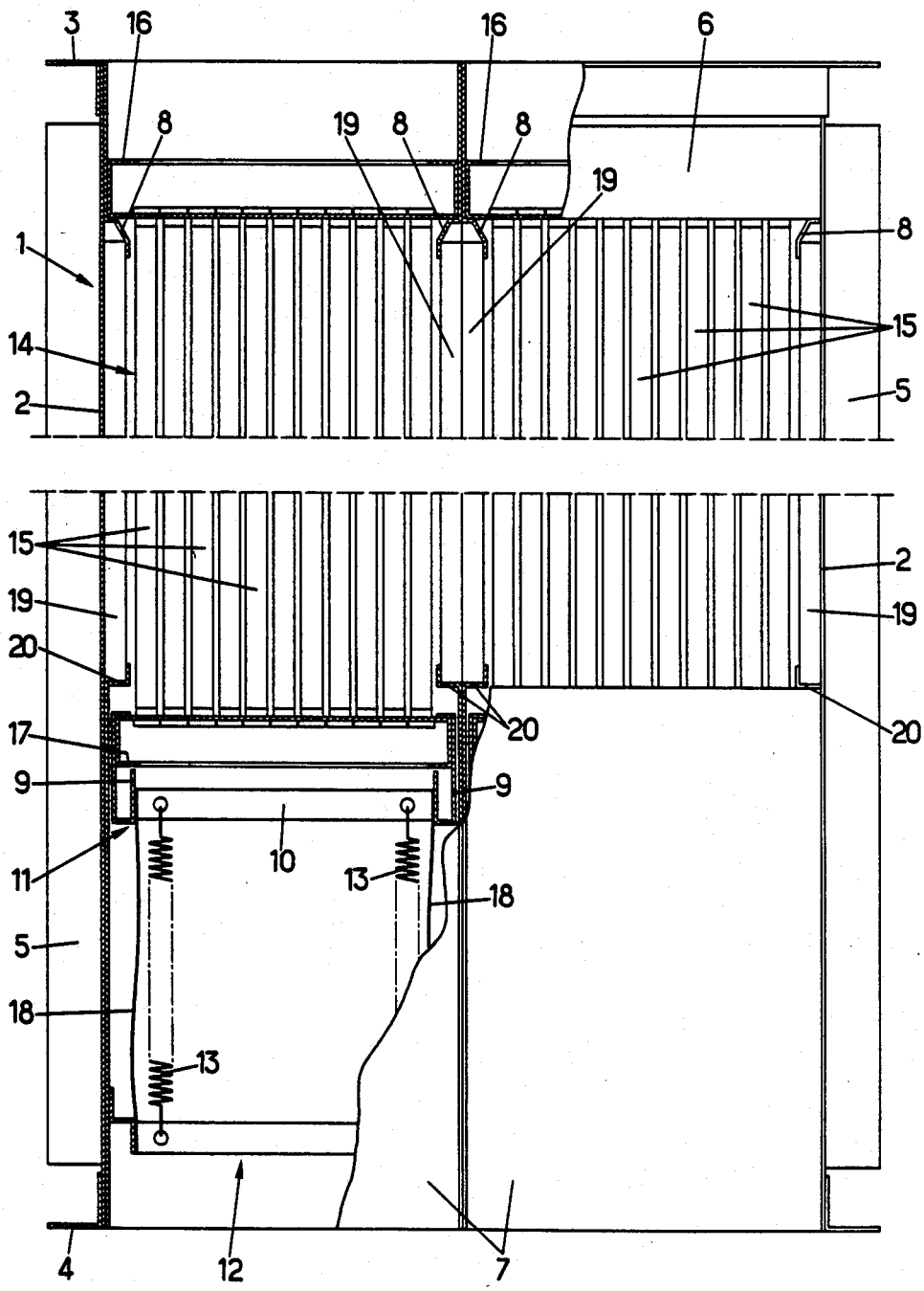
3
16
16
6
8
19
8
8
19
1
8
15
14
2
5
15
2
19
19
20
20
20
17
9
9
10
11
13
18
5
18
13
4
12
7

HEAT EXCHANGER HAVING REMOVABLE EXCHANGE SURFACES

The present invention relates to a heat exchanger, particularly a low-temperature recuperative heat exchanger comprising a casing and tubular or plate-type exchange surfaces mounted inside the casing.

The increased cost of energy makes it desirable to recuperate the maximum amount of sensible and latent heat contained in the humid air extracted either from factory shops or from production machines, particularly driers.

Since the temperature levels of the humid air extracted in this manner are relatively low, the recuperative heat exchangers may be of light construction.

On the other hand, in view of the fact that condensation usually takes place on the exchange surfaces and that the air extracted may contain corrosive vapours, periodical replacement of the exchange surfaces would be desirable.

Nevertheless, in known heat exchangers of this type, which are of monoblic construction, this replacement is practically out of the question because it would entail dismantling the entire heat exchanger.

The object of the present invention is a heat exchanger, particularly a low-temperature recuperative heat exchanger, which allows easy and quick replacement of the exchange surfaces without requiring dismantling of the entire heat exchanger.

In the heat exchanger according to the invention, which comprises a casing and tubular or plate-type exchange surfaces mounted inside this casing, the exchange surfaces are joined together in the form of at least one module removably mounted in the casing for sliding after the style of a drawer.

The exchange surfaces of each module, which may be of the tubular or plate type, of metal, plastics material, composite material, rubber, or other materials, are preferably held between two end plates mounted for sliding in the casing after the style of drawers.

For the purpose of receiving these end plates, the casing is preferably provided with two pairs of opposite rails per module. In order in particular to ensure compensation for thermal expansion of the exchange surfaces, the rails of one of these pairs may be fixed to the casing and those of the other pair may be movable perpendicularly to the plane of the end plate.

The heat exchanger preferably includes a tensioning device, for example springs, acting on the movable rails and urging them away from the fixed rails.

In a preferred embodiment the movable rails for each module are connected together, at least at their two ends, to form a movable frame, while the tensioning device is attached between this movable frame and a frame fixed to the casing.

A flexible sleeve is preferably disposed between the movable frame and the fixed frame to ensure leaktightness between the movable frame and the heat exchanger casing.

Removable panels are advantageously disposed as partitions between the various exchange surface modules, and also between the exchange surface module or modules and the casing walls, in such a manner as to close preferential passages. These panels may advantageously be mounted slidingly in rails fixed to the heat exchanger casing.

One illustrative and non-limitative form of construction of a heat exchanger according to the invention will be described below with reference to the single figure of the accompanying drawing.

The single figure of the drawing is a front view, partly in section, of a heat exchanger comprising two modules of flexible tubes.

According to the single figure of the drawing a heat exchanger, through which one fluid passes vertically and another fluid passes at right angles to the plane of the drawing, comprises a casing 1 consisting mainly of two opposite side walls 2, a top flange 3 and a bottom flange 4 for connection to a fluid circuit, together with front and rear flanges for connection to another fluid circuit. Like the rear flange (not shown), the front flange comprises two vertical wings 5 and horizontal wings consisting of two top panels 6 and two bottom able bottom panels 7.

At the top end of the casing 1 four horizontal rails 8 are fixed, two of these rails being fixed on the inner faces of the opposite side walls 2 and the other two rails being fixed midway between the two walls 2.

Four rails 9 are disposed on the casing 1 some distance above the bottom end of the latter, namely two rails facing the inner faces of the opposite side walls 2 and two rails sidway between the two walls 2. The rails 9 are movable vertically. Each bottom rail 9 situated facing a side wall 2 and each opposite sidway rail 9 are connected together by cross-members 10 to form a vertically movable frame 11.

At the bottom end of the casing 1 a frame 12 is rigidly fixed to the casing 1 some distance below each movable frame 11. Tension springs 13 are attached on the the one hand to the movable frame 11 and on the other hand to the fixed frame 12, these springs 13 urging the frame 11 towards the frame 12, that is to say urging the movable rails 9 away from the fixed rails 8.

The rails 8 and 9 serve to receive two exchange surface modules 14, which in the example illustrated are composed of parallel tubes 15 whose ends are fixed to opposite end plates 16 and 17. Each of the two modules 14 can be engaged in the casing 1, its top end plate 16 sliding on two opposite top rails 8 and its bottom end plate 17 in two opposite bottom rails 9. Through the action of the springs 13 the bottom rails 9 are pulled downwards, so that the bottom rails 9 and the top rails 8 and also the bottom end plate 17 and the top end plate 16 are urged apart, that is to say the tubes 15 are tensioned. At the same time, this provides compensation for thermal expansion of the tubes 15.

A flexible sleeve 18 disposed between each fixed bottom frame 12 and each movable top frame 11 ensures at that point, that is to say below the tubes 15, the leaktightness of the circuit of the fluid passing through the heat exchanger vertically. Panels 19 are in addition mounted slidingly between top U-shaped rails, consisting of the rails 8, and bottom U-shaped rails 20, which rails are fixed in the one case on the opposite side walls 2 of the casing 1 and in the other case midway between the opposite side walls 2, above the movable bottom rails 9. The removable panels 19 thus close off preferential passages between neighbouring modules 14, by acting as partitions, and between the modules 14 and the casing walls 2.

It should be noted that the panels 6 and 7, which are detachably fastened, for example be means of screws (not shown), cover the end plates 16 and 17 of the exchange surface modules 14 and thus hold these modules in position.

For the purpose of replacing the modules 14, it is sufficient, after disconnecting on one side of the heat exchanger the circuit of fluid passing through the heat exchanger at right angles to the plane of the drawing, to remove the panels 6 and 7 on that side, to withdraw the modules 14 by a sliding action, and then to insert new modules 14 and refix the panels 6 and 7, after which the fluid circuit can be reconnected to the heat exchanger.

It is obvious that the embodiment described and illustrated has been given only as an illustrative, nonlimitative example, and that numerous modifications and variants are possible within the scope of the invention. Thus, the exchange surfaces could be of the plate type instead of being tubular. Instead of having two exchange surface modules, the heat exchanger according to the invention could contain only a single module, in which case it would have no intermediate partition 19; or it could for example comprise three, four, or five modules and two, three, or four intermediate partitions 19. The number and the arrangement of the rails 8, 9, 20 for the end plates 16 and 17 and for the panels 19 would have to be selected accordingly. Furthermore, variants are conceivable for the sliding guidance of the end plates of the exchange surface modules, particularly for the movable rails, and for the means for tensioning and compensation for thermal expansion of the exchange surfaces.

We claim:

1. Heat exchanger comprising a casing (1) and exchange surfaces (15) of the tubular or plate type which are joined together in the form of at least one module (14) removably mounted inside the casing (1), the exchange surfaces (15) of each module (14) being disposed between two end plates (16, 17) and the casing (1) being provided with two pairs of two rails (8, 9) for the sliding mounting of the two end plates (16, 17) of each module, characterized by the fact that the rails comprise a first pair of two fixed rails (8) for one (16) of the end plates and a second pair of rails (9), movable perpendicularly to the plane of said rails, for the other end plate (17), the movable rails (9) of the second pair of rails being urged by a tensioning device (13) away from the rails (8) of the other pair.

2. Heat exchanger according to claim 1, characterized by the fact that the moveble rails (9) are joined together to form a moveble frame (11), and that the tensioning device (13) is disposed between this movable frame (11) and a frame (12) fixed to the casing.

3. Heat exchanger according to claim 2, characterized by the fact that the tensioning device (13) comprises tension springs attached between the two frames (11, 12).

4. Heat exchanger according to claim 2 characterized by the fact that a flexible sleeve (18) is disposed between the moveble frame (11) and the fixed frame (12).

5. Heat exchanger according to claim 1, characterized by the fact that it is provided with rails (8, 20) between which are slidably mounted panels (19) closing the preferential passages between the different modules (14) of exchange surfaces (15) and/or between the module or modules (14) and the walls (2) of the casing (1).

* * * * *